US006588922B1

(12) United States Patent
DeCicco

(10) Patent No.: US 6,588,922 B1
(45) Date of Patent: Jul. 8, 2003

(54) RECESSED LIGHTING FIXTURE WITH A COLUMNAR OPEN MOUNTING FRAME

(75) Inventor: Thomas J. DeCicco, Hoffman Estates, IL (US)

(73) Assignee: Juno Lighting, Inc., Des Plaines, IL (US)

( * ) Notice: Subject to any disclaimer, the term of this patent is extended or adjusted under 35 U.S.C. 154(b) by 657 days.

(21) Appl. No.: 08/936,222

(22) Filed: Sep. 29, 1997

(51) Int. Cl.[7] ..... F21V 17/00
(52) U.S. Cl. ..... 362/364; 362/148; 362/365
(58) Field of Search ..... 362/365, 364, 362/148, 147, 410, 414

(56) References Cited

U.S. PATENT DOCUMENTS 4,232,362 A * 11/1980 Williams et al. ..... 362/410
4,399,497 A * 8/1983 Druffel ..... 362/362
5,122,944 A * 6/1992 Webb ..... 362/365
5,868,493 A * 2/1999 Winkelhake ..... 362/365

* cited by examiner

*Primary Examiner*—Cassandra Spyrou
*Assistant Examiner*—Euncha Cherry
(74) *Attorney, Agent, or Firm*—Anthony S. Zummer

(57) ABSTRACT

An open mounting frame for use in a recessed lighting fixture is the subject matter. The open mounting frame supports the recessed lighting fixture in a fixture aperture formed in a ceiling. The frame has an annular base ring. The base ring is engagable with the lower surface of the ceiling. The frame includes a pair of spaced apart columnar uprights connected to the base ring. The uprights are diametrically opposed to each other. The columnar uprights are connected to each other by a bridge which is connected to the ends of the columnar uprights. A lock is connected to each of the uprights. The locks engage the upper surface of the ceiling to cooperate with the base ring to hold the frame in the aperture.

9 Claims, 9 Drawing Sheets

RECESSED LIGHTING FIXTURE WITH A COLUMNAR OPEN MOUNTING FRAME

BACKGROUND OF THE INVENTION

Recessed lights for use in both residential and commercial structures are typically installed during construction of the structure. In a widely accepted installation, bar hangers are secured to parallel rafters and a plaster frame is supported by the bar hangers. A cylindrical housing is mounted on the plaster frame. The cylindrical housing typically includes a plaster ring with a cylindrical sidewall fixed to the ring. A flat top or cap is mounted on the sidewall. A junction box is connected to the housing. A lamp receptacle is mounted inside the housing. A baffle and a trim ring are mounted in the housing. A lamp is mounted in the receptacle and is positioned in line with the baffle.

Another well known recessed lighting fixture installation requires a different mounting frame to accommodate various lighting arrangements without bar hangers and plastic frame. The other fixtures include an open mounting frame construction which may be utilized in a variety of jurisdictions, and which frame may be used with a variety of lighting arrangements utilizing a construction which is highly cost effective.

SUMMARY OF THE INVENTION

The present invention is directed to an improved open mounting frame which is part of a recessed lighting fixture. The open mounting frame is adapted for supporting the recessed lighting fixture in a lighting fixture aperture formed in a ceiling without the use of bar hangers or plastic frames. The instant frame has an annular base ring. The base ring has a surface adapted for engagement with the exterior lower surface of the ceiling. A pair of spaced apart parallel columnar uprights is connected to the base ring. Each upright has one end fixed to the base ring. The uprights are diametrically opposed to each other on the base ring. The columnar uprights are connected to each other by a bridge. The bridge is connected to the free ends of the columnar uprights opposite the ends connected to the base ring. A lock is connected to each of the uprights. Each of the locks is engagable with the interior or upper surface of the ceiling to hold the frame in the aperture in cooperation with the annular base ring engaging the exterior lower surface of the ceiling and thereby secure the lighting fixture into position.

DETAILED DESCRIPTION OF THE PREFERRED EMBODIMENT

Figure 1:
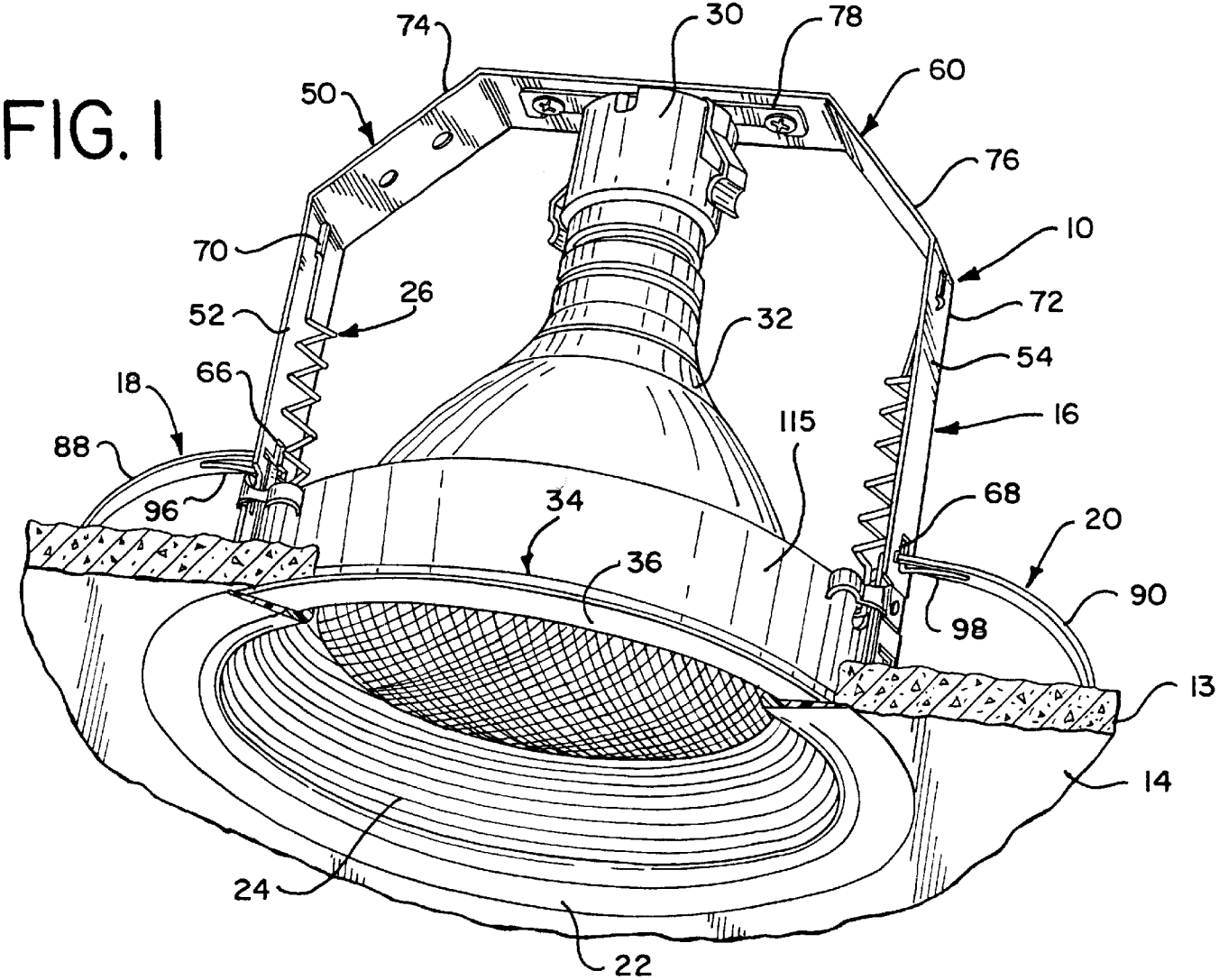
FIG. 1 is a perspective view of a recessed lighting fixture shown mounted in a fixture aperture in a ceiling with portions of the ceiling broken away and portions of lighting fixture broken away showing an open mounting frame embodying the present invention.
Figure 2:
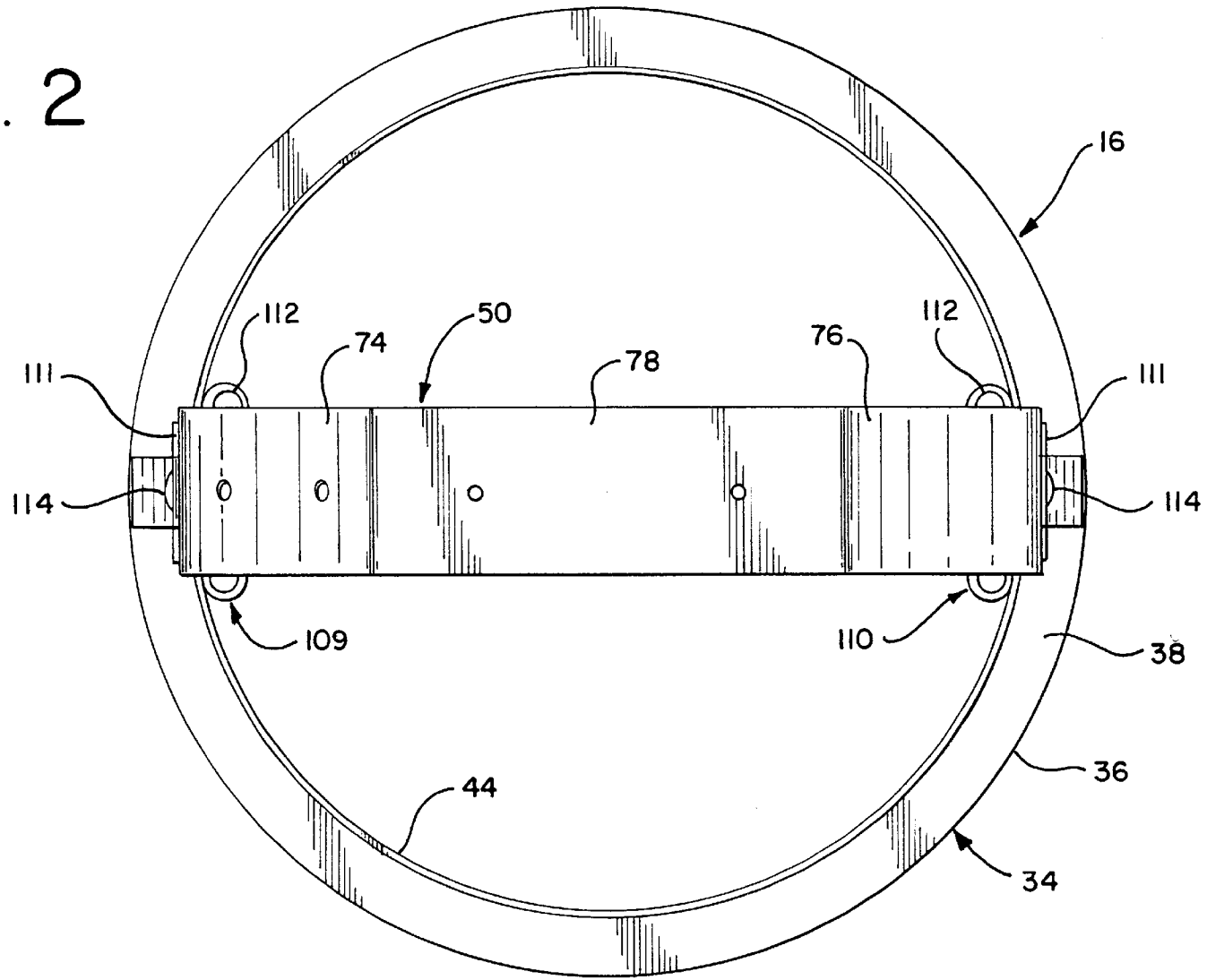
FIG. 2 is a top plan view of the open mounting frame of FIG. 1.
Figure 3:
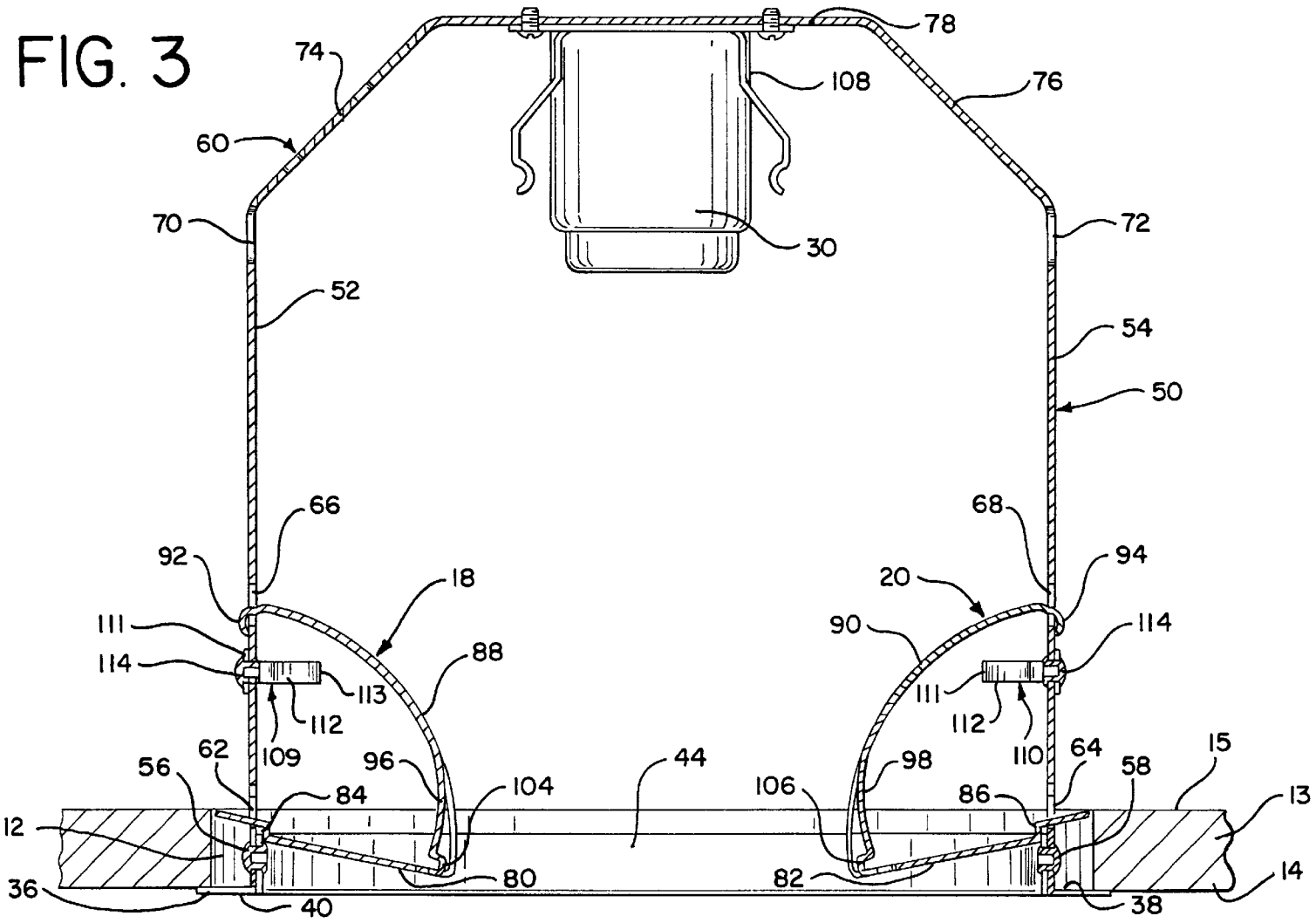
FIG. 3 is a cross sectional view of the open mounting frame of FIG. 1 shown positioned in an aperture of a ceiling with locks positioned in a retracted attitude.

Referring now the drawings, and especially to FIGS. 1 and 3, a recessed electric lighting fixture generally indicated by numeral 10 is shown mounted in a lighting fixture aperture 12 of a conventional ceiling 13 having a lower exterior surface 14 and an upper interior surface 15. The lighting fixture includes an open mounting frame 16 held in aperture 12 by a pair of locks 18 and 20, which locks are in engagement with upper surface 15. A conventional trim ring 22 and a conventional baffle 24 are connected to frame 16 by a pair of identical coil springs 26 and 28. A conventional lamp receptacle 30 is mounted on frame 16. The receptacle is connected by a well known and conventional means to a conventional source of electric power, none of which is shown herein. A conventional incandescent lamp 32 is mounted in receptacle 30. The lamp extends into baffle 24, as is conventional.

Open mounting frame 16 includes a thin wall annular base ring 34. The base ring includes a flat annulus 36 which has an inner face 38 and an outer face 40. The inner face defines a plane for engagement with lower surface 14 of ceiling 13. The annulus defines a circular opening 42. A thin wall cylindrical short crown 44 is formed integral with annulus 36. The short crown is perpendicular to the plane of inner face 38. The short crown includes an outer wall 46 and an inner wall 48, which cooperates with the annulus to define opening 42.

Open mounting frame 16 includes a U-shaped flat strap support 50 having diametrically opposed ends connected to annular base ring 34. The U-shaped support 50 has a pair of flat columnar diametrically opposed uprights 52 and 54, which are mirror images of each other. A rivet 56 secures one end of upright 52 to short crown 44, and a rivet 58 secures a like end of columnar upright support 54 to the diametrically opposite side of short crown 44, so that the uprights are diametrically opposed to each other. The other ends of the uprights 52 and 54 are connected to each other by a flat strap bridge 60. The bridge has opposite ends formed integral with the uprights so that the U-shaped support 50 is an integral flat support. Uprights 52 and 54 have respective T-slots 62 and 64 formed therein adjacent to each end fixed to the short crown. Uprights 52 and 54 have respective lock retainer slots 66 and 68 formed therein for receipt of a respective lock. Uprights 52 and 54 have respective coil spring receptacles 70 and 72 formed therein adjacent to the respective juncture with bridge 60.

Bridge 60 includes a flat sloped support 74 formed integral with upright 52 and a flat sloped support 76 formed integral with upright 54. A flat span 78 has its opposite ends formed integral with sloped supports 74 and 76 to complete bridge 60. Span 78 is parallel to the plane of inner face 38 so that the span is parallel to lower exterior surface 14 of the ceiling when the frame is mounted in a ceiling.

Locks 18 and 20 are identical in construction to each other. Each lock is an integral spring steel member. Locks 18 and 20 include posts 80 and 82, respectively. Posts 80 and 82 have respective off-sets 84 and 86 positioned in lock retainer slots 66 and 68, respectively. Locks 18 and 20 also include arcuate retainers 88 and 90, formed integrally with posts 80 and 82, respectively. Heads 92 and 94 are on the free end of respective arcuate retainers 88 and 90 for engagement with upper surface 15 of the ceiling. Each of the locks 18 and 20 has respective latches 96 and 98 formed integral with respective arcuate retainers 88 and 90. Latches 96 and 98 include latch arms 100 and 102, respectively, with respective latch hooks 104 and 106.

A lamp receptacle clip 108 is mounted on span 78 and receives conventional lamp receptacle 30, which has its axis perpendicular to the span. Lamp 32 is mounted in the lamp receptacle and is therefore perpendicular to span 78 and lower surface 14 of the ceiling when the frame is mounted in the fixture aperture.

Torque spring receptacles 109 and 110 are identical in construction to each other and like numerals are used to identify like parts. Each of the torque spring receptacles includes a bracket 111 with a pair of opposed arms 112 extending in opposite directions from the bracket. An ear 113 is formed integral with the free end of each arm. Torque spring receptacles 109 and 110 are secured to respective uprights 52 and 54 by a rivet 114 through respective brackets 111. The torque spring receptacles receive torque springs as described hereinafter.

Trim ring 22 has a shell 115 which receives baffle 24. Spring apertures 116 and 118 are diametrically opposed in the shell, as may be best seen in FIG. 5. Coil spring 26 has a lower hook 120 mounted in aperture 116 in engagement with the shell. In like manner, coil spring 28 has a lower hook 122 mounted in aperture 118 in engagement with the shell. Coil spring 26 has an upper hook 124 positioned in spring receptacle 70, and coil spring 28 has an upper hook 126 positioned in spring receptacle 72. The coil springs hold resiliently the trim ring against lower surface 14 of ceiling 13.

Referring now the FIG. 3, recessed lighting fixture assembly 10 may be readily and conveniently mounted in fixture aperture 12. As is conventional, opening or aperture 12 is made in the ceiling. Open mounting frame 16 with the lamp receptacle mounted on the span and locks 18 and 20 in a retracted position, is placed in the fixture aperture. Frame 16 is moved up into the aperture to the attitude shown in FIG. 3, so that inner face 38 of the annulus engages the exterior lower surface 14 of the ceiling. The plane of inner face 38 is parallel to the lower surface of the ceiling so that span 78 is parallel to the lower surface of the ceiling. Locks 18 and 20 are pushed outward from the respective columnar uprights until respective heads 92 and 94 of locks 18 and 20 resiliently engage the interior or upper surface 15 of the ceiling. The locks latch into position since latch hooks 104 and 106 of locks 18 and 20, respectively, engage respective uprights to secure the locks in the attitude shown in FIGS. 4 and 5. The locks in cooperation with the annulus hold the frame in the aperture.

Figure 4:
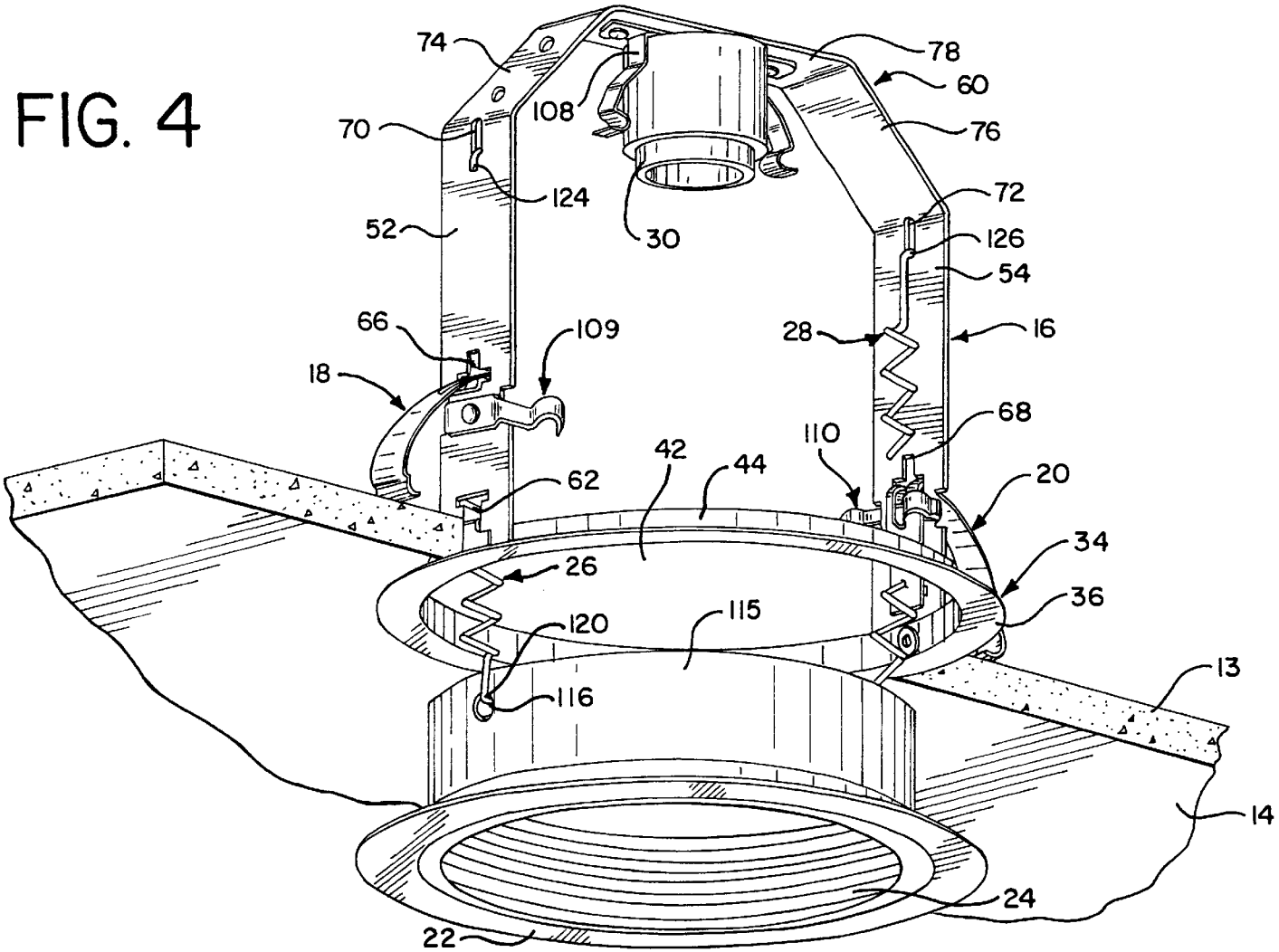
FIG. 4 is a perspective view of a lighting fixture having an open mounting frame positioned in a ceiling aperture and a baffle and trim ring positioned in an attitude for insertion into the frame.
Figure 5:
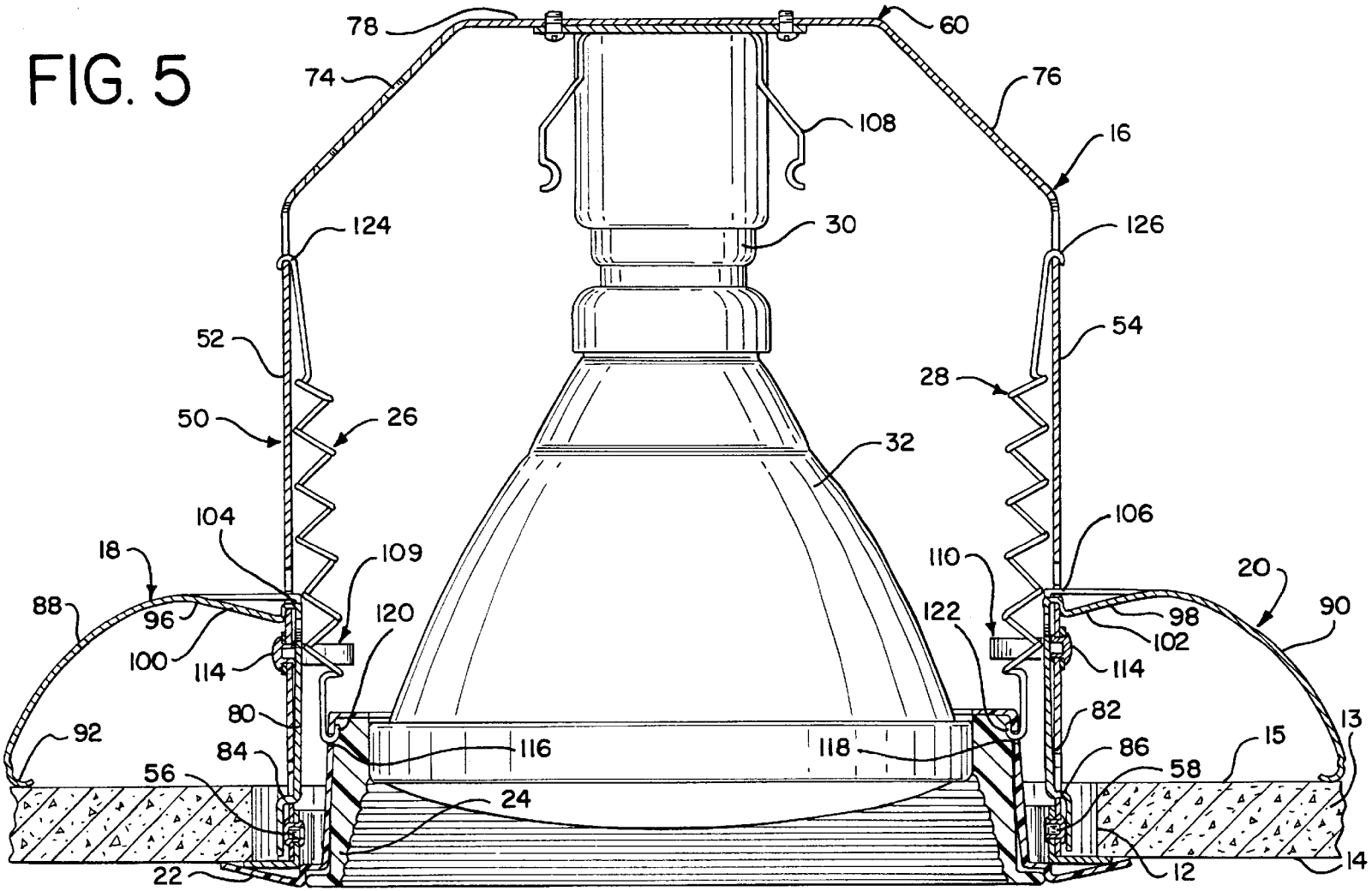
FIG. 5 is a cross sectional view of the lighting fixture of FIG. 1.

The trim ring and baffle with lower hooks 120 and 122 mounted in position are inserted into the frame as shown in FIG. 4. Upper hooks 124 and 126 of the respective coil springs are placed into respective spring receptacles 70 and 72. The resilience of coil springs 26 and 28 pulls the trim ring and baffle up into opening 42 of the annulus until the upper surface of the trim ring engages the lower surface of the ceiling, as shown in FIG. 5. Lamp 32 is inserted into its receptacle and the recessed light fixture assembly is complete. The lamp is perpendicular to lower surface 14 of the ceiling for optimum positioning.

Figure 6:
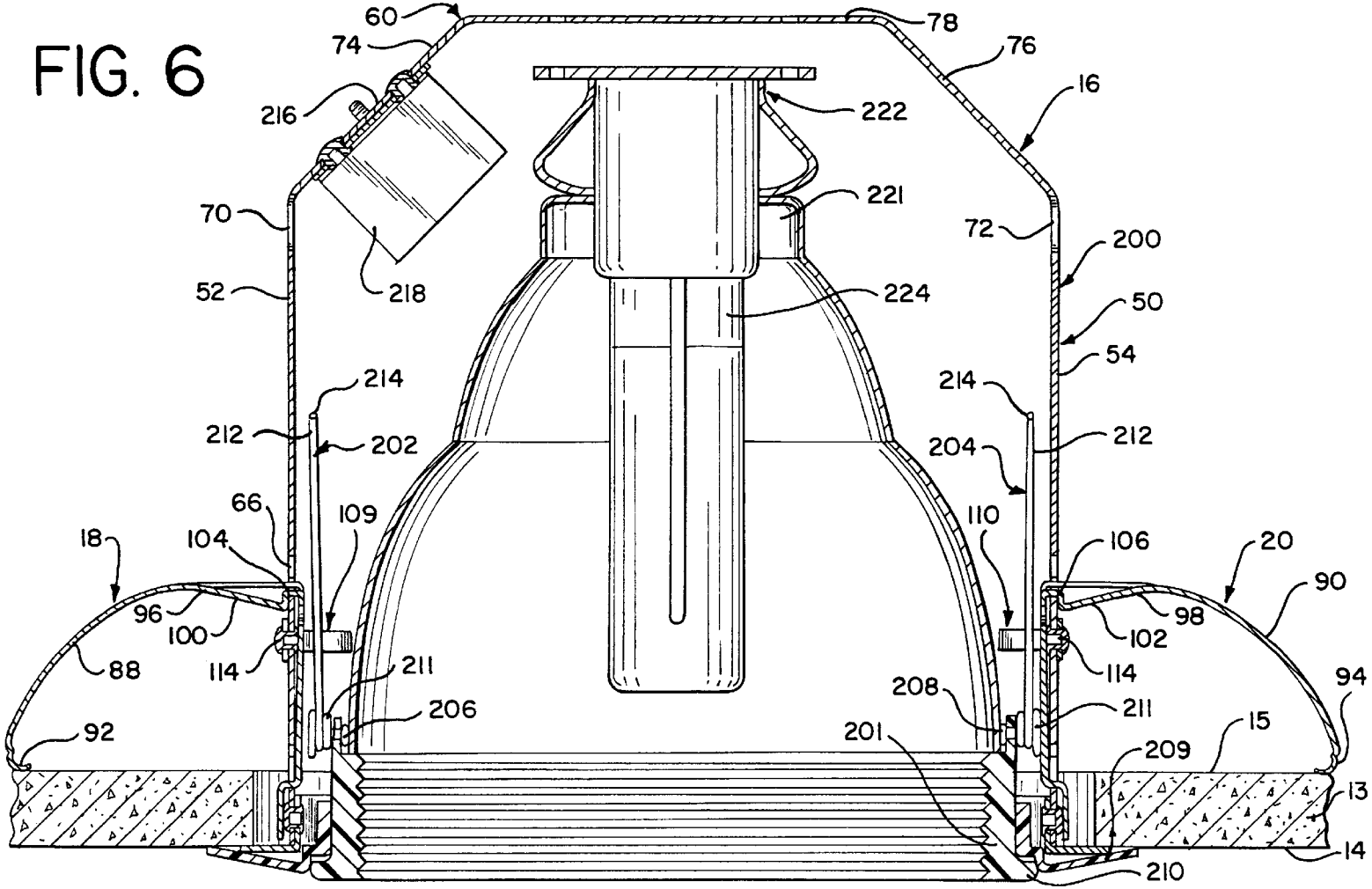
FIG. 6 is a cross sectional view of a lighting fixture similar to the lighting fixture of FIG. 5, but showing a fluorescent lamp and ballast mounted on an open mounting frame and a baffle and trim ring held in position by torque springs.

The instant open mounting frame may also be used with a fluorescent tube light source rather than an incandescent lamp. Like numbers are used to identify parts which have been described hereinabove, and parts which have not been described hereinabove are identified by numerals which start with the numeral 200. FIG. 6 shows the construction of a recessed lighting fixture 200 with a fluorescent tube light source. A conventional baffle 201 is shown mounted in open mounting frame 16 with a pair of torque springs 202 and 204 mounted on studs 206 and 208, respectively. A trim ring 209 is mounted on a bead 210 formed as an integral part of baffle 201.

The construction of the torque springs is conventional and well known. Like numbers are used for like parts of the springs. Each of the springs has a coil body 211 which receives the respective stud, as shown in FIG. 6. A pair of arms 212 extends outward from each coil body. Each arm has a retainer 214 extending at substantially right angles to the arms and away from the opposite arm, as is conventional.

Sloped support 74 includes a ballast mounting plate 216 with a conventional and well known ballast 218 secured to the ballast mounting plate.

Conventional reflector 220 is mounted on baffle 201. The reflector includes an opening 221 at its upper end with a fluorescent tube receptacle 222 positioned on top of the reflector. A conventional fluorescent tube 224 is mounted in the tube receptacle. The ballast is connected to a conventional source of electric current and the ballast is conventionally connected to receptacle 222, and thus, to tube 224. None of these connections are shown therein since they are conventional and well known.

Recessed lighting fixture 200 having the fluorescent tube is assembled in much the same manner as lighting fixture 10. Ballast plate 216 with ballast 218 is secured to sloped surface 74. Open mounting frame 16 is inserted into the aperture in the ceiling and locked into place by locks 18 and 20, as described above. The ballast is connected to the source of electric current and the ballast is also connected to the fluorescent tube receptacle. The reflector with receptacle 222 mounted thereon is positioned on baffle 201. The trim ring with the baffle are inserted into the frame by first inserting the arms of the torque springs into the respective torque spring receptacles. Retainers 214 on the arms engage ears 112 of the torque spring receptacle to prevent the baffle and the trim ring from falling down. The trim ring and the baffle are pushed into the opening of the annulus until the upper surface of the trim ring engages the lower surface of the ceiling, as shown in FIG. 6. The trim ring and baffle are held in position by the torque springs in their respective torque spring receptacles. Baffle 201 with receptacle 222 may be withdrawn from the open mounting frame by pulling downward trim ring 209 and baffle 201 against the force of the torque springs 202 and 204.

Figure 7:
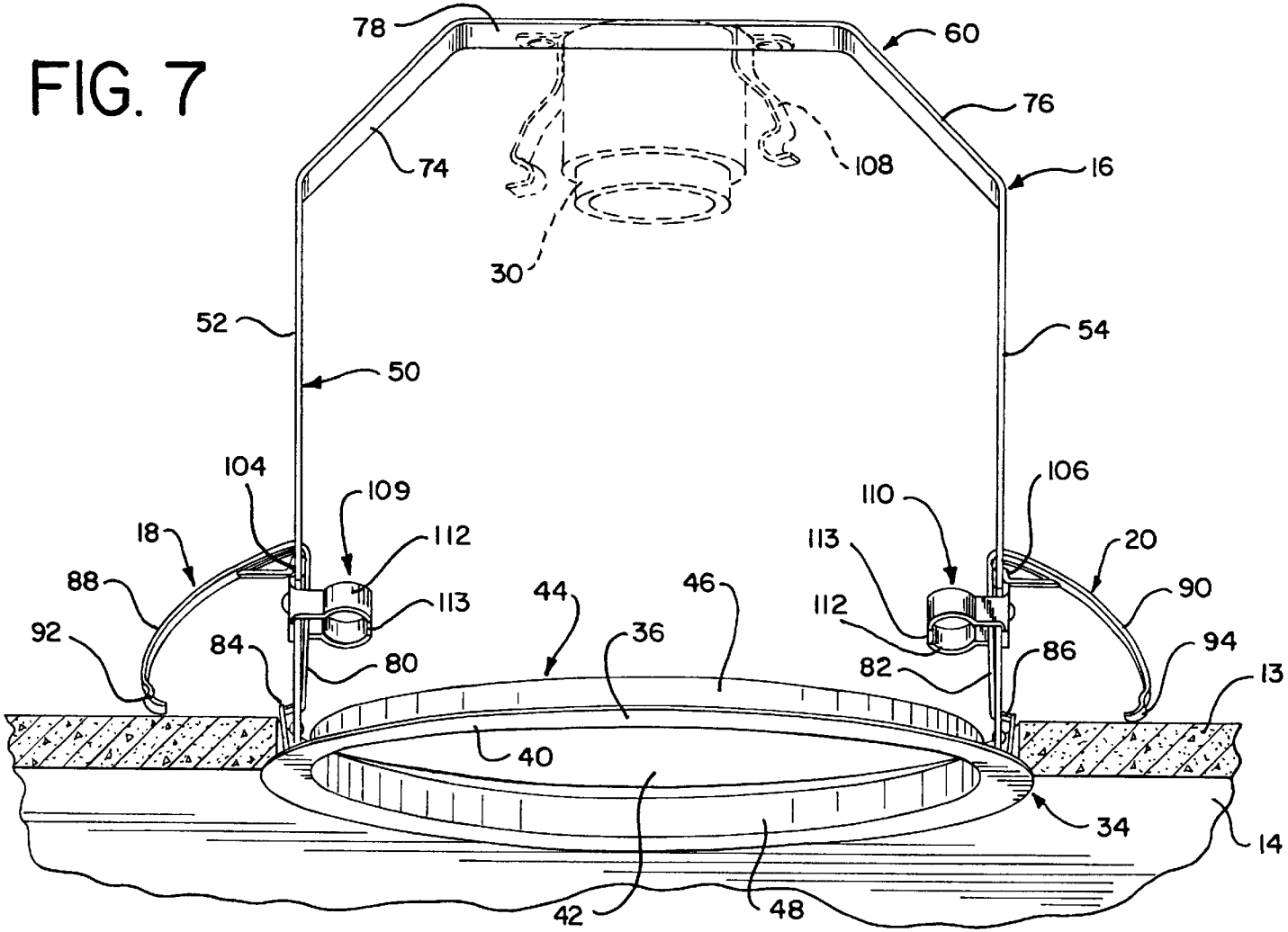
FIG. 7 is a perspective view showing the open mounting frame with locks in a holding attitude and a lamp receptacle in dotted form.
Figure 8:
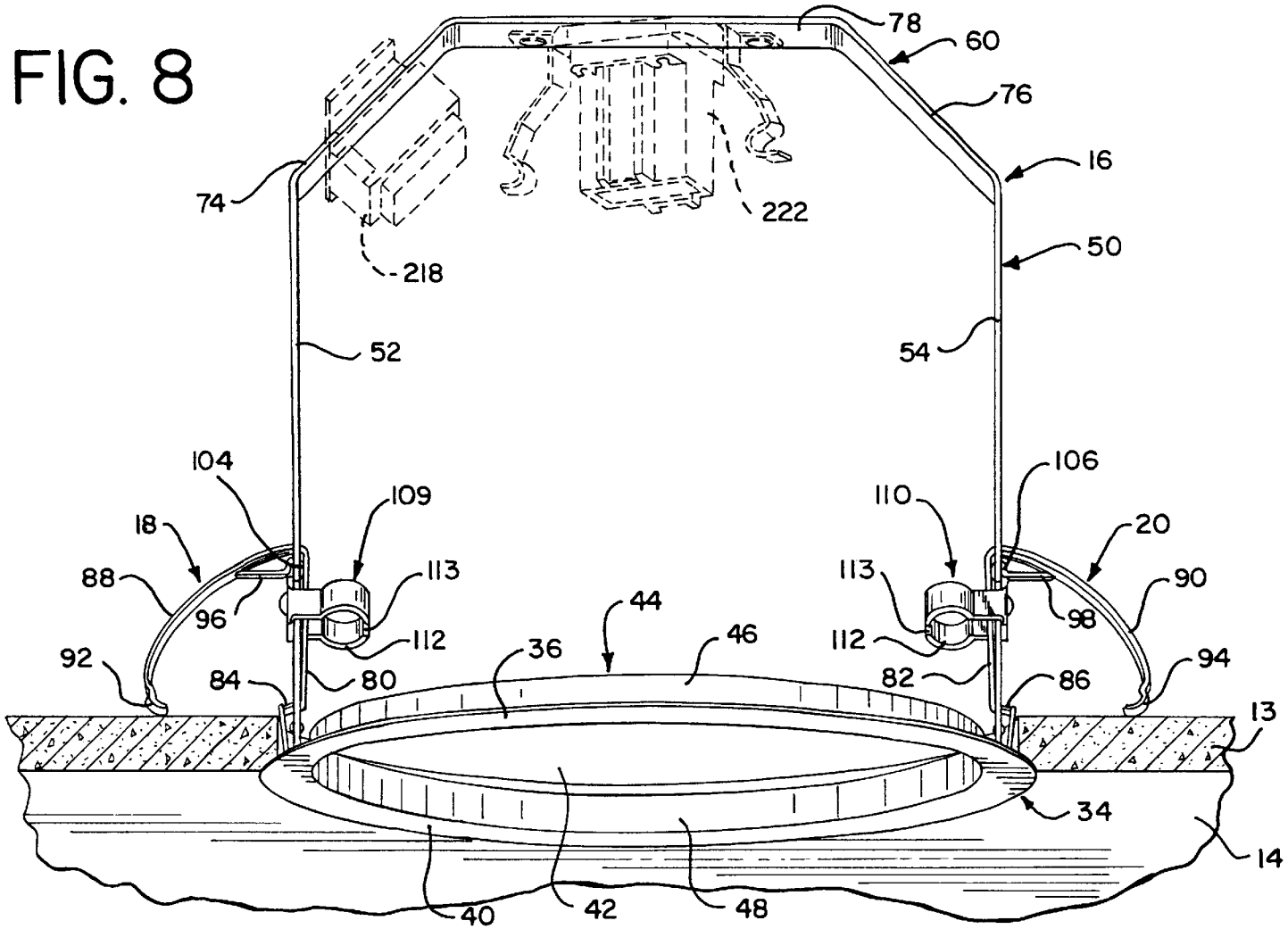
FIG. 8 is a perspective view similar to FIG. 7, but showing a ballast and fluorescent lamp receptacle in dotted form.
Figure 9:
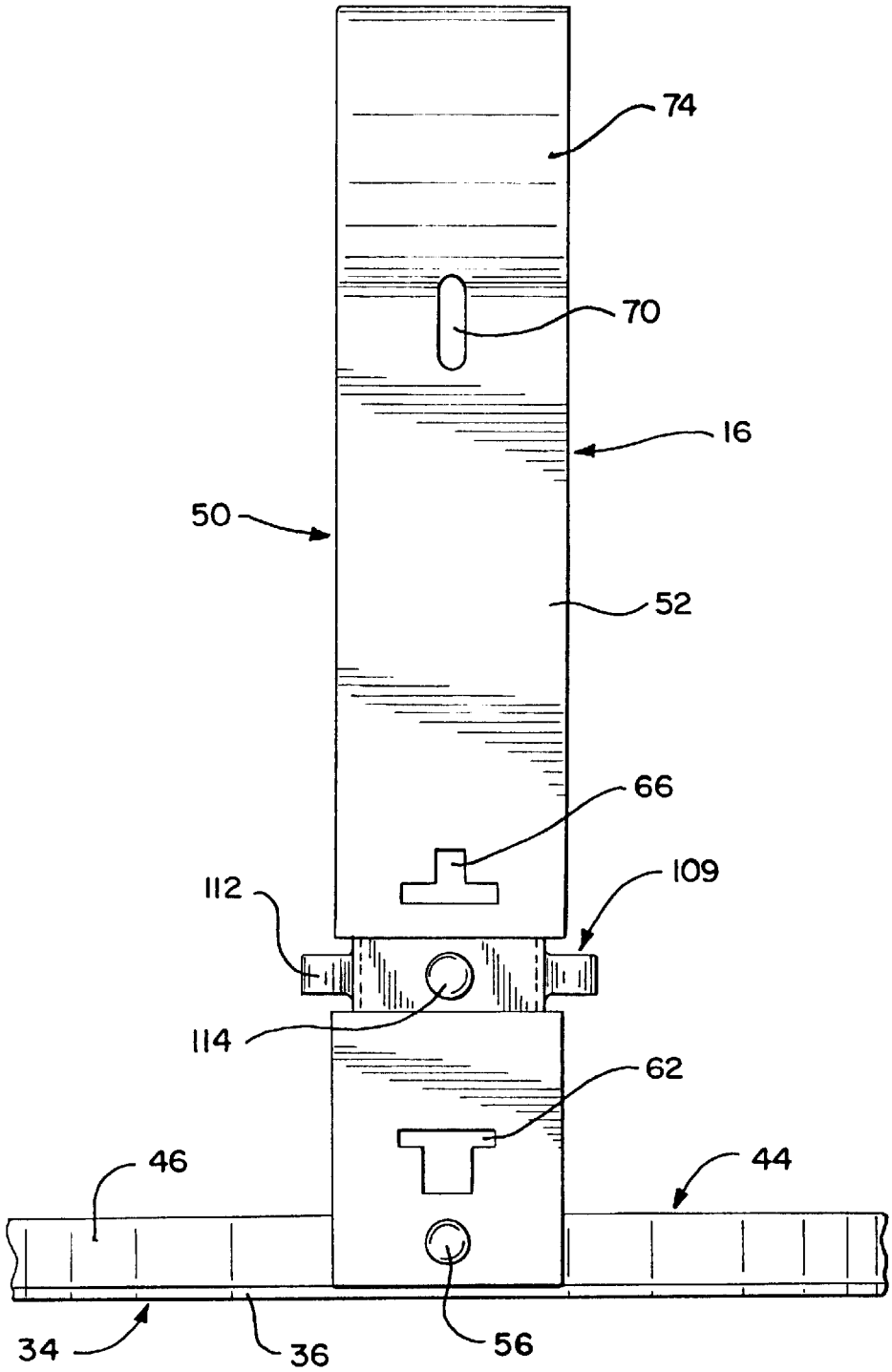
FIG. 9 is a side elevational view of the open mounting frame shown in FIG. 2.

The foregoing demonstrates how frame 16 may be used for different lighting fixtures. FIGS. 7 and 8 are illustrative of the versatility of the frame. FIG. 7 shows the frame in the fixture aperture and a lamp receptacle 30 is shown in position in dotted form while FIG. 8 shows the same frame 16 in a like position, but with the ballast and fluorescent tube receptacle shown in position in dotted form.

Although a specific embodiment of the hereinabove invention has been shown and described in detail hereinabove, it is readily apparent that those skilled in the art may make various modifications and changes without departing from the spirit and scope of the present invention. It is to be expressly understood that the present invention is limited only by the appended claims.

What is claimed is:

1. An open mounting frame of a recessed lighting fixture for supporting the recessed lighting fixture in a fixture aperture formed in a ceiling having a lower surface and upper surface, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the uprights, each of the locks being adapted to engage the upper surface of the ceiling to hold the frame in the fixture aperture in cooperation with the base ring, said bridge includes a pair of sloped supports, each of the supports having one end fixed to a respective columnar upright, and a span connecting the sloped supports at their respective ends opposite to the end fixed to the columnar uprights, said span adapted to support a lamp socket.

2. An open mounting frame of a recessed lighting fixture for supporting the recessed lighting fixture in a fixture aperture formed in a ceiling having a lower surface and an upper surface, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the uprights, each of the locks being adapted to engage the upper surface of the ceiling to hold the frame in the fixture aperture in cooperation with the base ring, said base ring includes an annulus adapted for engaging the lower surface of the ceiling, said annulus having a portion in one plane, and a short crown formed integral with the annulus, said short crown positionable within the fixture aperture in the ceiling, said bridge includes a pair of sloped supports, each of the said supports having one end fixed to a respective columnar upright, and a span connecting adjacent ends of the sloped supports.

3. An open mounting frame of a recessed lighting fixture for supporting the recessed lighting fixture in a fixture aperture formed in a ceiling having a lower surface and an upper surface, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the uprights, each of the locks being adapted to engage the lower surface of the ceiling to hold the frame in the fixture aperture in cooperation with the base ring, a torque spring receptacle mounted on each of the columnar supports, a torque spring releasably engageable with each torque spring receptacle, each torque spring adapted for connection to a baffle mounted with in the base ring, said bridge includes a pair of sloped supports, each of the supports having one end fixed to a respective columnar upright, a span connecting adjacent ends of the sloped supports, said base ring includes a substantially flat annulus adapted for engaging the lower surface of the ceiling, said flat annulus having a portion in one plane, and a short crown formed integral with the flat annulus, said short crown positionable within the fixture aperture in the ceiling, said short crown fixed to said columnar uprights.

4. An open mounting frame of a recessed lighting fixture for supporting the recessed lighting fixture in a fixture aperture formed in a ceiling having a lower surface and an upper surface, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the uprights, each of the locks being adapted to engage the upper surface of the ceiling to hold the frame in the fixture aperture in cooperation with the base ring, said bridge includes a pair of sloped supports, each of the supports fixed at one end to a respective columnar upright, and a span connecting adjacent ends of the sloped supports, a ballast mount fixed to one of said sloped supports for supporting a ballast, said base ring includes a substantially flat annulus adapted for engaging the lower surface of the ceiling, said flat annulus having a portion in one plane, and a short crown formed integral with the flat annulus, said short crown positionable within the fixture aperture in the ceiling.

5. An open mounting frame of a recessed lighting fixture for supporting the recessed lighting fixture in a fixture aperture formed in a ceiling having a lower surface and an upper surface, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the uprights, each of the locks being adapted to engage the upper surface of the ceiling to hold the frame in the fixture aperture in cooperation with the base ring, said bridge includes a pair of sloped supports, each of the supports having one end fixed to a respective columnar upright, a span connecting adjacent ends of the sloped supports, each of said columnar supports includes a coil spring receptacle for receiving one end of a respective coil spring, a coil spring mounted in each coil spring receptacle, each coil spring having one end connected to the respctive coil spring receptacle and an opposite end connected to a baffle, said base ring includes a substantially flat annulus adapted for engaging the lower surface of the ceiling, said flat annulus having a portion in one plane, and a short crown formed integral with the flat annulus, said short crown positionable in the fixture aperture in the ceiling, and each of said columnar supports having one end fixed to the short crown.

6. An open mounting frame of a recessed lighting fixture for supporting the recessed lighting fixture in a fixture aperture formed in a ceiling having a lower surface and an upper surface, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the uprights, each of the locks being adapted to engage the upper surface of the ceiling to hold the frame in the fixture aperture in cooperation with the base ring, said bridge includes a pair of sloped supports, each of said supports fixed to one end of a respective columnar upright, a span connecting adjacent ends of the sloped supports, a torque spring receptacle mounted on each of the columnar uprights, and a torque spring releasably engageable with each of the torque spring receptacles.

7. An open mounting frame of a recessed lighting fixture for supporting the recessed lighting fixture in a fixture aperture formed in a ceiling having a lower surface and an upper surface, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the upright, each of the locks being adapted to engage the upper surface of the ceiling to hold the frame in the fixture aperture in cooperation with the base ring, said bridge being a flat strap including a pair of flat sloped supports, each of the supports fixed to one end of a respective columnar upright, a flat span connecting adjacent ends of the sloped supports, and a ballast mount fixed to one of said sloped supports.

8. An open mounting frame of a recessed lighting fixture for supporting the recessed lighting fixture in a fixture aperture formed in a ceiling having a lower surface and an upper surface said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the upright, each of the locks being adapted to engage the upper surface of the ceiling to hold the frame in the fixture aperture in cooperation with the base ring, said bridge being a flat strap including a pair of flat sloped supports, each of the supports fixed to one end of a respective columnar upright, a flat span connecting adjacent ends of the sloped supports, and each of said columnar uprights includes a coil spring receptacle for receiving one end of a coil spring, each of the coil spring receptacles positioned adjacent to a respective sloped support.

9. An open mounting frame of a recessed lighting fixture for supporting the recessed lighting fixture in a fixture aperture formed in a ceiling having a lower surface and an upper surfaces, said frame having an annular base ring, said base ring adapted to engage the lower surface of the ceiling, a pair of spaced apart columnar uprights connected to the base ring, each upright having one end connected to the base ring, said uprights being substantially diametrically opposed to each other, said columnar uprights connected to each other by a bridge, said bridge connected to ends of the columnar uprights opposite the ends connected to the base ring, a lock connected to each of the uprights, each of the locks being adapted to engage the upper surface of the ceiling to hold the frame in the fixture aperture in cooperation with the base ring, said base ring is a thin wall ring including a substantially flat annulus adapted for engaging the lower surface of the ceiling, said flat annulus having a portion in one plane, a thin wall short crown formed integral with the flat annulus, said short crown substantially perpendicular to said plane of the flat annulus, each of said uprights being flat and having one end fixed to the short crown, each of said uprights substantially perpendicular to the plane of the flat annulus, said short crown positionable within the fixture aperture in the ceiling, said bridge is a flat strap including a pair of flat sloped supports, each of the supports formed integral with a respective columnar upright, and a flat span formed integral with adjacent ends of the sloped supports, said span substantially parallel to the plane of the flat annulus, and a spring connected to each upright, each spring having one end connected to its respective upright and an opposite end connected to a baffle mounted in the base ring.

* * * * *